United States Patent [19]

Takatori

[11] 4,343,254

[45] Aug. 10, 1982

[54] METHOD AND APPARATUS FOR CLOSING THE TOE END OF A HOSE

[75] Inventor: Osho Takatori, Nara, Japan

[73] Assignee: Takatori Machinery Works Ltd., Japan

[21] Appl. No.: 116,960

[22] Filed: Jan. 30, 1980

[30] Foreign Application Priority Data

Jan. 30, 1979 [JP] Japan ..... 54-010204

[51] Int. Cl.[3] ..... D05B 19/00; D05B 21/00

[52] U.S. Cl. ..... 112/262.2; 112/121.15; 112/DIG. 2

[58] Field of Search ..... 112/121.15, DIG. 2, 112/262.2, DIG. 3, 121.11, 121.12, 121.26, 2; 223/112

[56] References Cited

U.S. PATENT DOCUMENTS

| | | | |
|---|---|---|---|
| 3,738,294 | 6/1973 | Christiansen | 112/121.15 |
| 3,859,938 | 1/1975 | Fukuyama | 112/121.15 |
| 3,941,069 | 3/1976 | Fukuyama | 112/121.15 X |
| 3,952,673 | 4/1976 | Fukuyama | 112/121.15 |
| 4,120,251 | 10/1978 | Takatori et al. | 112/121.15 |
| 4,133,276 | 1/1979 | Selui | 112/121.15 |

*Primary Examiner*—H. Hampton Hunter

*Attorney, Agent, or Firm*—Lerner, David, Littenberg & Samuel

[57] ABSTRACT

A pair of cam driven finger pieces of a holder unit for a hose such as a seamless hose allow travel of the toe section of the hose across the sewing region on a sewing machine along a prescribed arc locus and timely controlled ejection of air jet in the sewing region enables successful and stable sewing action on the toe section even with use of a fixed sewing machine. High production rate is resulted despite simple and compact construction.

10 Claims, 17 Drawing Figures

METHOD AND APPARATUS FOR CLOSING THE TOE END OF A HOSE

BACKGROUND OF THE INVENTION

The present invention relates to improved method and apparatus for closing the toe end of a hose, and more particularly relates to improvement in formation of an arc sew line on the toe section of a hose on any conventional sewing machine of the fixed type without requirement for any complicated accessories.

One example of the conventional apparatus for closing the toe end of a seamless hose (hereinafter referred to simply as "toe closer") is disclosed in U.S. Pat. Nos. 3,941,069 and 3,952,673 and is now in use for actual production of seamless hoses. In the closing operation on this conventional toe closer, a pair of finger pieces are inserted into a seamless hose material prepared inside out in order to stretch it laterally. The seamless hose material is then transferred to a holder of a sewing mechanism and the finger pieces withdrawn from the interior of the seamless hose material so held by the holder in order to enable sewing of its rear toe section. Thereafter, the rear toe section is removed from the holder and pneumatically passed to the next process for completion of toe closing.

The average production rate on the above-described conventional toe closer is about 400 dozens per 8 hours. This relatively low production rate is caused by the disadvantage that, even when the sewing machine is of a fixed type, it is required to vertically clamp the toe section of a seamless hose material in a free state by a holder and to circularly rotate the holder, thereby provisionally disabling the lateral movement of the seamless hose material.

In the case of the conventional automatic toe closer, further, it is indispensable to move the sewing machine circularly about the axis of the hose material for circular sewing of the toe end of the material hose. When a sewing machine of the above-described fixed type is used, it is indispensable to use the rotary type holder. In either case, the construction of the toe closer has to be inevitably complicated and enlarged, which naturally causes an undesirable rise in production cost of hoses.

SUMMARY OF THE INVENTION

It is one object of the present invention to enable curved toe closing on hoses at an appreciably high production rate whilst using any conventional sewing machine of a fixed type.

It is another object of the present invention to enable curved toe closing on hoses with a simple and compact construction for the apparatus.

It is another object of the present invention to successfully carry out curved toe closing on hoses at a low production cost.

In accordance with the present invention, the abovedescribed curved toe closing on hoses is practiced by tactful used of a specially designed cam mechanism in combination with timely ejection of an air jet in the sewing region. The cam mechanism is operationally coupled to a pair of finger pieces adapted for holding each hose material so that the toe section of the hose material held in a prescribed arc form is forced to travel along an arc locus for sewing on any conventional sewing machine of a fixed type while concurrently cutting off the outer unnecessary cloth section. This allows easy production of a hose having the round toe section of a sufficiently small radius of curvature. Since the sewing operation does not intercept the lateral movement of the material hose at all, employment of the present invention assures a high production rate such as 600 dozens per 8 hours. In one embodiment of the present invention, hose material can be fed to the sewing machine at every 2 seconds.

DESCRIPTION OF THE PREFERRED EMBODIMENTS

Figure 1:
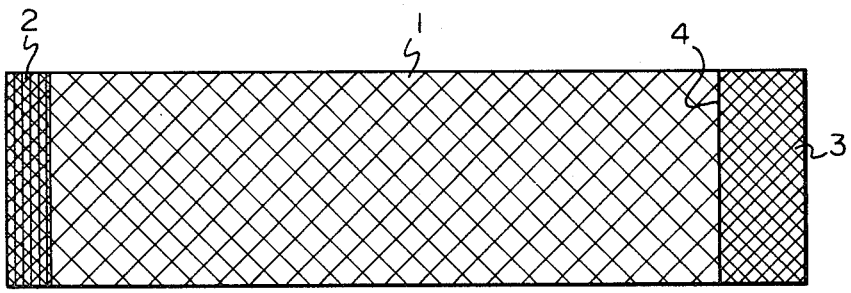
FIG. 1 is a plan view of a seamless hose material before toe closing.

One example of the material to be closed at the toe end in accordance with the present invention is shown in FIG. 1, which illustrates an elongated main section 1 of the hose made of a thin cloth, a welt section 2 containing rubber threads and integral at one longitudinal end of the main section 1 and a toe section 3 made of a thick cloth and connected to another longitudinal end of the main section 1 along a uniting line 4.

Figure 2:
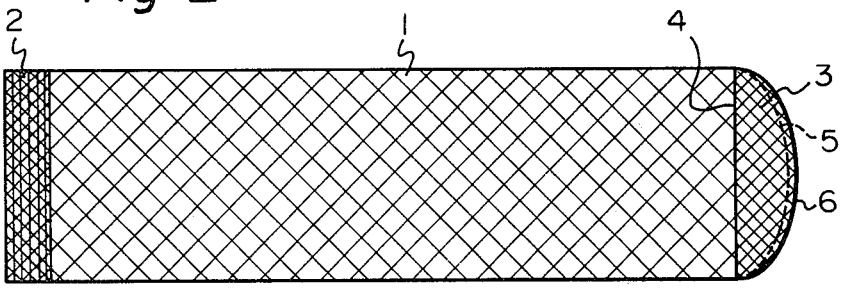
FIG. 2 is a plan view of a toe closed seamless hose of a desirable form.

A hose obtained by properly closing the toe end of the above-described material is shown in FIG. 2. In this case, the position of the uniting line 4 is unchanged even after closing of the toe end and the uniting line 4 remains substantially straight as in the material shown in FIG. 1 Whereas the toe section 3 outside the uniting line 4 has a round fringe 6 and a sew line 5 of a smaller diameter. With this shape, the toe section 3 of the hose fully covers the toes of the user in use.

Figure 3:
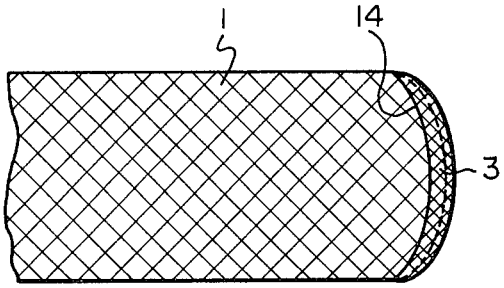
FIG. 3 is a plan view of a toe closed seamless hose of an undesirable form.

When the hose is provided with a curved uniting line 14 and the toe section 3 assumes a crescent shape as shown in FIG. 3, the toe section 3 is unable to fully cover the toes in use and the toes are placed in touch with the main section 1 also.

The present invention contemplates production of hoses of the type shown in FIG. 2 which assures a comfortable fit to users' feet. The present invention also contemplates such production without use of any complicated sewing mechanism by making use of the large stretchability inherent to hosieries.

The toe end closing process in accordance with the present invention includes the following sequential operational steps in order to complete one cycle of operation.

(a) The first step. An operator holds a tubular hose material and allows its toe section to be sucked into a pneumatic suction pipe while holding its welt section.

(b) The second step. Suction is stopped, the welt section is placed on the outer surface of the suction pipe, and the remnant of the hose is positively and automatically rolled up in order to turn the hose inside out. The toe end of the hose to be closed should be left outside the suction pipe.

(c) The third step. A pair of finger pieces are moved away from each other in order to stretch the toe section outwards, thereby arching the toe section. Keeping this stretched state of the hose toe section, the finger pieces are moved towards a sewing machine.

(d) The fourth step. The finger pieces holding the hose are moved laterally in a direction perpendicular to the sewing machine. During sewing to be carried out concurrently with this lateral movement, the hose is moved along an arched locus by means of a cam mechanism so that an arched sew line is formed on the hose. Along with this sewing, the section of the hose outside the sew line is cut off.

(e) The fifth step. The finger pieces are moved towards each other, the closed hose is turned inside in and removed off from the suction pipe by means of another pneumatic suction.

Among the above-described five sequential steps, the gist of the invention relates mainly to the fourth step, and its main operation is shown in FIGS. 4 through 7.

Figure 4:
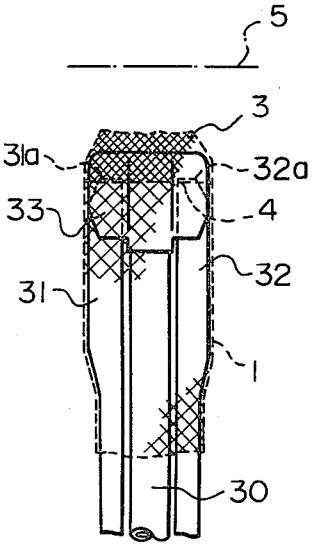
FIGS. 4 through 7 are plan views showing sequential steps of toe closing carried out on a seamless hose held by a pair of finger pieces.

In FIG. 4 the main section 1 of a hose to be closed is inserted over a pneumatic suction pipe 30 fixed to a holder and a pair of finger pieces 31 and 32 arranged on both lateral sides of the suction pipe 30, with the toe section 3 extending beyond the mouth of the suction pipe 30. This state of the hose is obtained by registering ends of the uniting line 4 on the hose at front corners 31*a*, 32*a* of the finger pieces 31 and 32, respectively.

Figure 6:
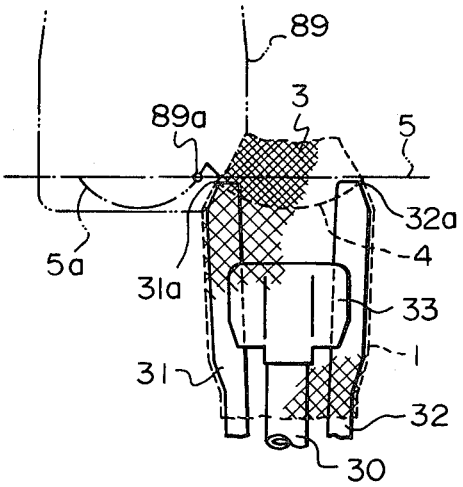
Figure 5:
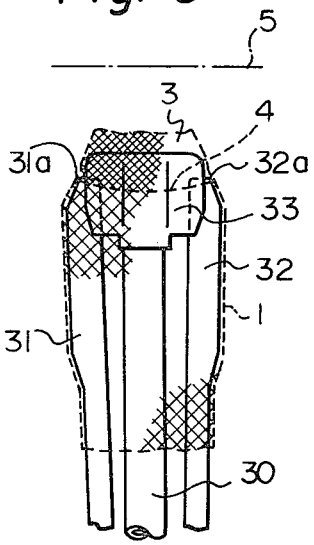
Figure 7:
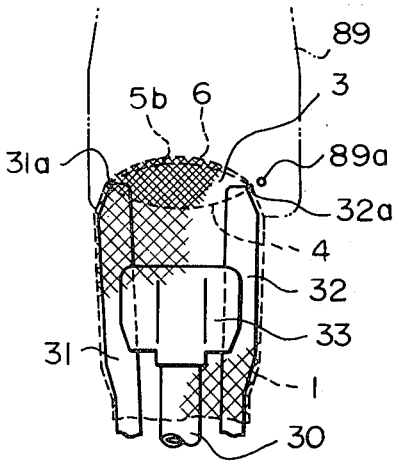

Next, the finger pieces 31 and 32 are moved laterally from each other as shown in FIG. 5, and also moved forwardly with respect to the suction pipe 30, thereby carrying the hose with them. As the main section 1 of the hose is made of a highly stretchable hoisery, it has a constant and strong urge to resume its original shape when laterally stretched. Thus, when the toe section 3 is brought to a position remote from the head piece 33 of the suction pipe 30, the toe section 3 assumes a roughly arched shape as shown in FIG. 6.

Keeping this state, the hose is registered at the sew line 5 and moved laterally in a direction perpendicular to the sewing machine. Concurrently with this lateral movement, the hose is moved along a curved locus 5*a* by means of the later described cam mechanism, thereby forming an arched sew line 5*b* shown in FIG. 7, which is roughly symmetric to the curved locus 5*a* with respect to the sew line 5. Thereafter, the hose is released from holding. Then, due to the excellent resilience of the hose, the resultant hose possesses a curved sew line 5 (toe close line) and the round fringe 6 as shown in FIG. 2.

Figures 8A, 8B, 8C:
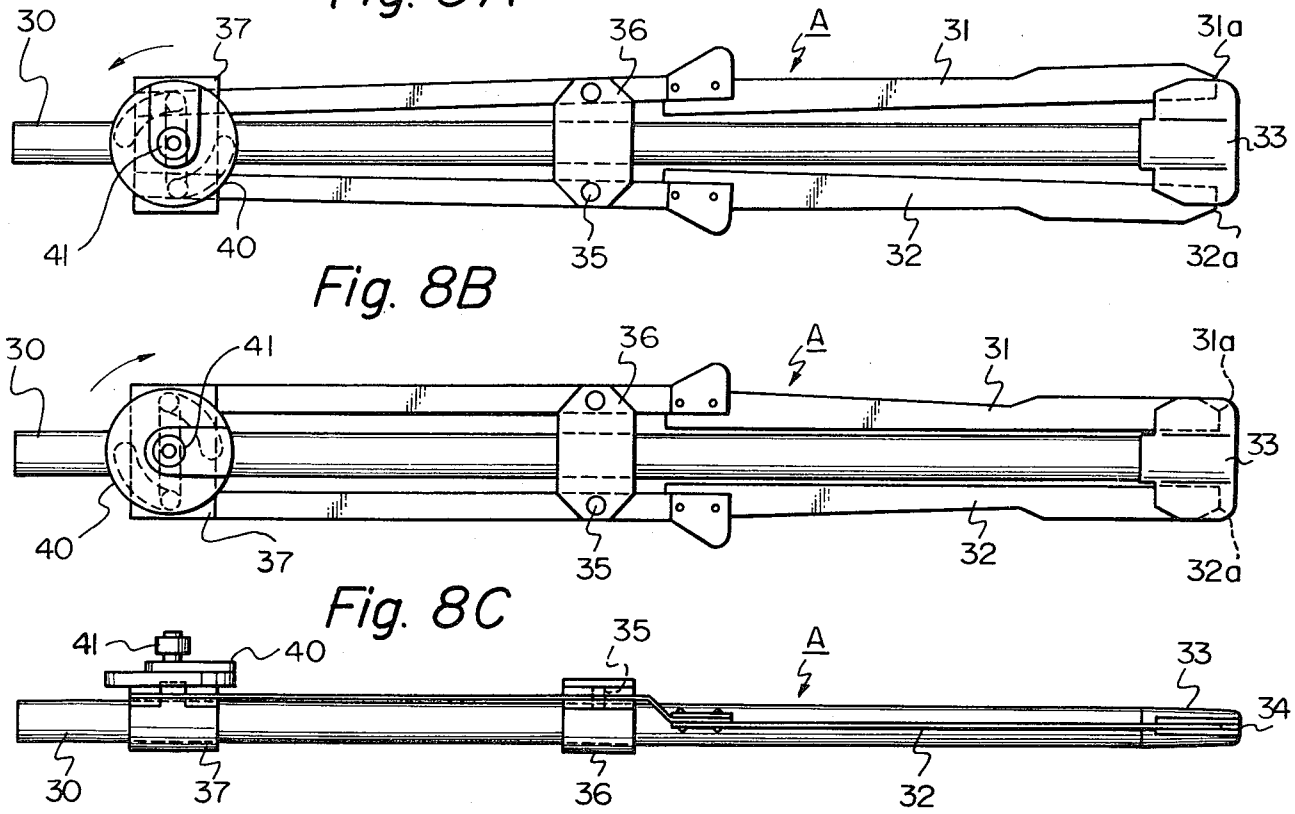
FIG. 8A is a plan view of a unit for holding a hose with its finger pieces being in open state.
FIG. 8B is a plan view of the holding unit with its finger pieces in closed state.
FIG. 8C is a side view of the holding unit.

The construction of the holder for the finger pieces 31 and 32 and the suction pipe 30 is shown in detail in FIGS. 8A through 8C. The head piece 33 is fixed to the front end of the suction pipe 30. A pair of guide grooves 34 are formed in the side surfaces of the head piece 33. A middle slider 36 and a rear slider 37 are assembled to the suction pipe 30 in a fashion to slide along the latter. The front corners 31*a* and 32*a* of the finger pieces 31 and 32 are slidably engageable with the associated guide grooves 34 formed in the head piece 33. Pivotal couplings are established between the middles of the finger pieces 31 and 32 and the middle slider 36 by means by pins 35.

The rear slider 37 is provided on its top with a rotary disc 40 adapted for driving the finger pieces 31, 32 for the lateral movement. To this end, a slot is formed through the rear slider 37 in a direction normal to the longitudinal direction of the finger pieces 31 and 32. A pair of arc grooves are formed in the bottom of the rotary disc 40 at symmetric positions with respect to its center whilst extending over a prescribed center angle. Upright pins are secured to the tops of the finger pieces 31 and 32 at positions adjacent their rear ends, which slidably engage the associated arc grooves in the rotary disc 40 via the slot in the rear slider.

Upon rotation of the rotary disc 40 into one direction shown in FIG. 8A, the pins on the finger pieces 31 and 32 are forced to move towards each other due to engagement with the arc grooves and, as a consequence, the finger pieces 31 and 32 are both forced to swivel about the pins 35 so that their front ends move away from each other, i.e. the finger pieces 31 and 32 open.

Upon reverse rotation of the rotary disc 40 into another direction shown in FIG. 8B, starting from the state in FIG. 8A, the pins on the finger pieces 31 and 32 are forced to move away from each other again due to engagement with the arc grooves and, as a consequence, the finger pieces 31 and 32 are forced to swivel about the pins 35 so that their front ends move towards each other, i.e. the finger pieces 31 and 32 close.

The finger pieces 31 and 32, the middle slider 36 and the rear slider 37 form a unit A which is movable along the suction pipe 30 towards and away from the head price 33.

Figure 9:
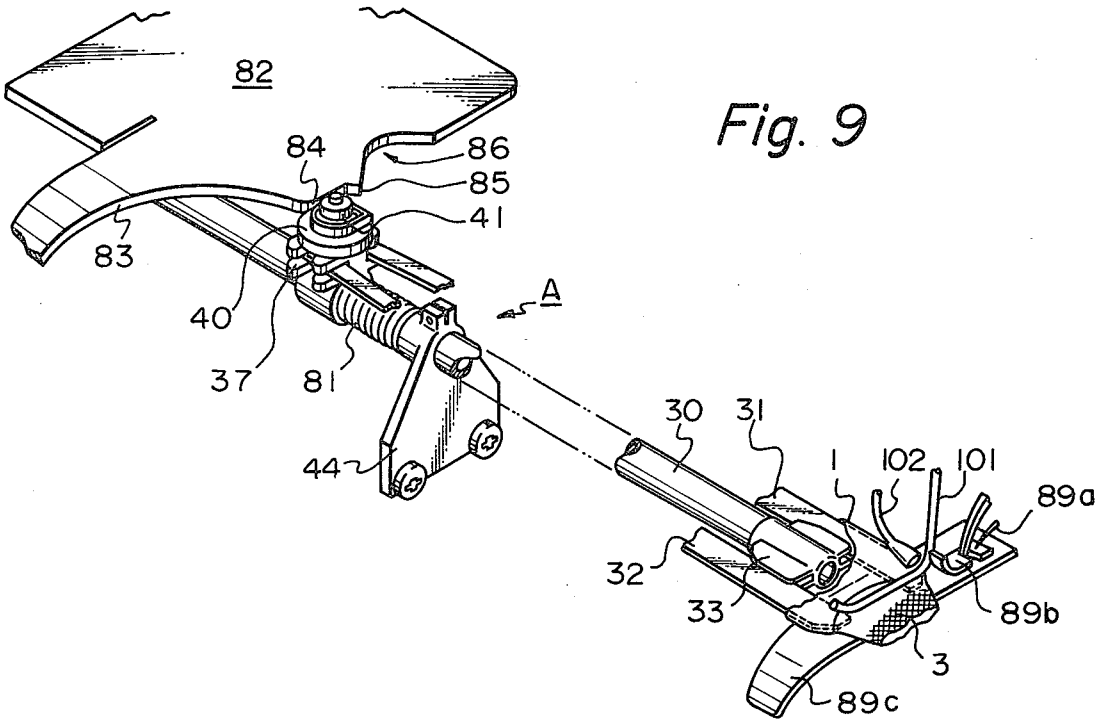
FIG. 9 is a perspective view of one embodiment of the apparatus in accordance with the present invention.
Figure 10:
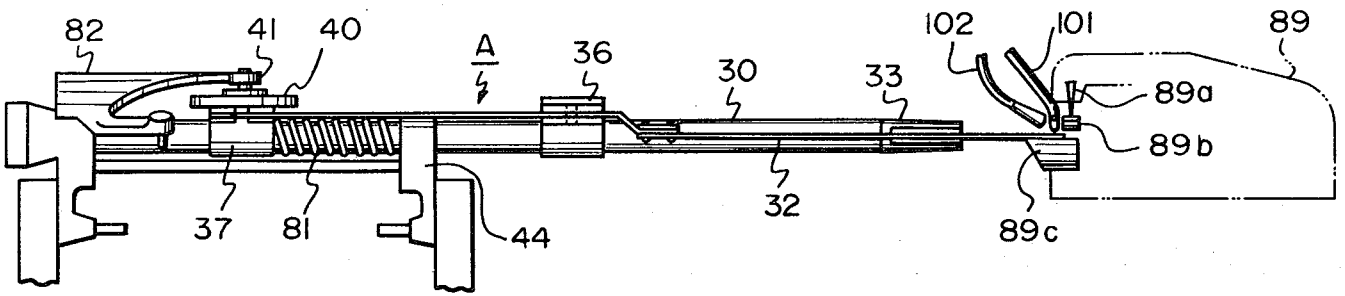
FIG. 10 is a side view of the apparatus shown in FIG. 9 and its associated sewing machine.
Figure 11:
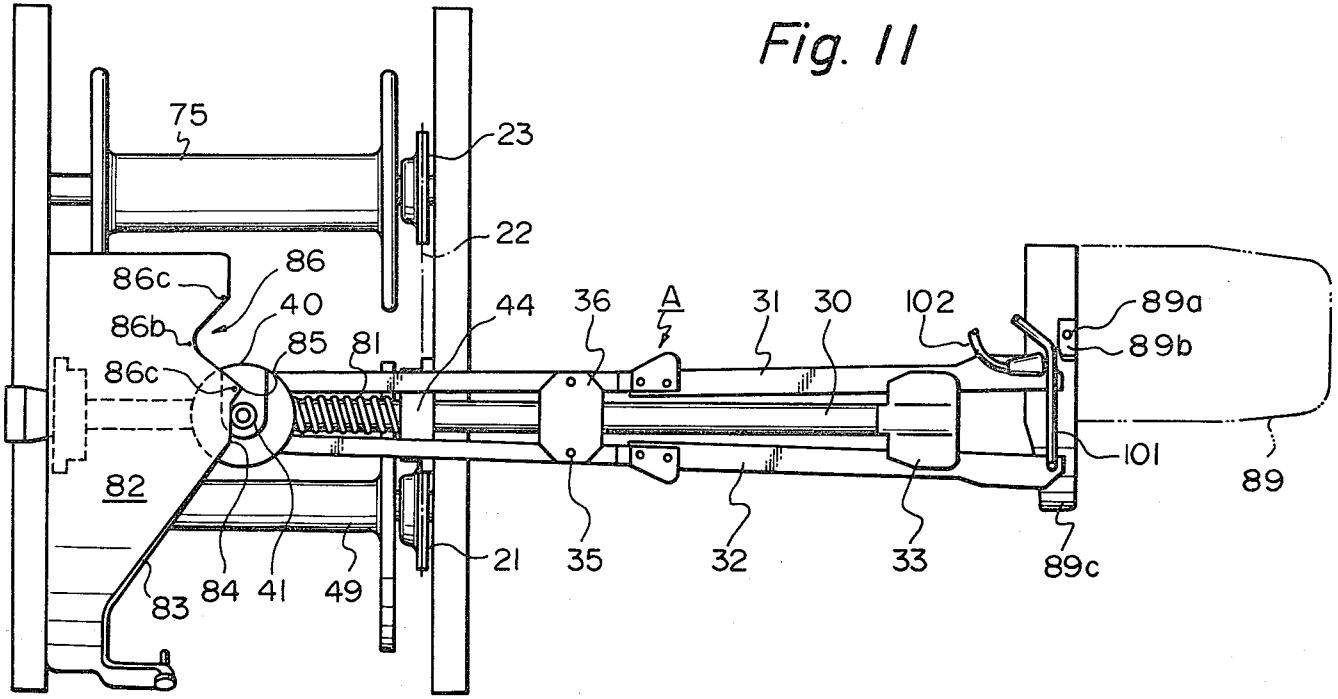
FIG. 11 is a plan view of the arrangement shown in FIGS. 9 and 10.

An embodiment of means for causing such a movement of the unit A is shown in FIGS. 9 through 11. A bracket 44 is arranged movably along the framework of the apparatus and securedly carries the above-described suction pipe 30. The axial direction of the suction pipe 30 is normal to the moving direction of the bracket 44 along the framework. The bracket 44 is located between the middle slider 36 and the rear slider 37 and a compression spring 81 is interposed between the bracket 44 and the rear slider 37 whilst winding around the suction pipe 30.

A cam plate 82 is secured to the framework of the apparatus at a position above the rear slider 37 having a top rotary cam follower 41. The cam plate 82 is provided with continuous cam surfaces 83, 84 and 85 engageable with the cam follower 41, and an arc cam surface 86. The cam surfaces 83 and 86 are both concave in the front side of the cam plate 82.

As the bracket 44 moves laterally in FIG. 9, the unit A is forced to move forwards relative to the suction pipe 30, whilst surmounting the repulsion of the spring 81, due to the sliding contact of the cam follower 41 on the rear slider 37 with the cam surface 83 on the cam plate 82. As the cam follower 41 comes in contact with the next cam surface 84, the unit A and the suction pipe 30 assume the relative position shown in FIG. 6.

Next, the cam follow 41 comes in contact with the cam surface 85 in the form of a small projection at the terminal of the cam surface 84 and the unit A further moves forward from the position shown in FIG. 6 so that the beginning end of the toe section 3 is fed into a space between a cloth clamper **89*b* and a needle plate 89*c* on a sewing machine 89**.

Figure 12:
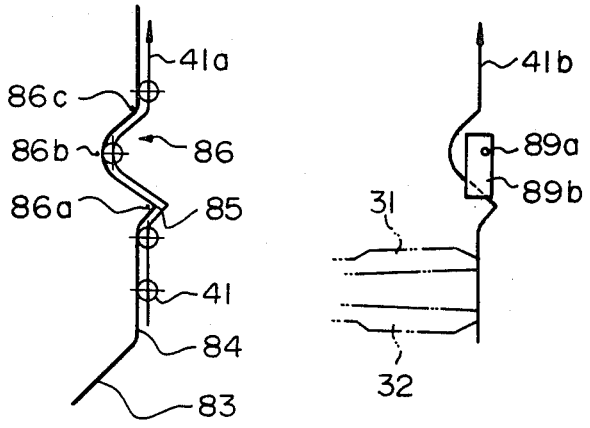
FIG. 12 is an explanatory plan view for showing the lateral movement of the foremost ends of the finger pieces along an arc locus in accordance with the present invention.

Further lateral movement of the bracket 44 brings the cam follower 41 into contact with the arc cam surface 86 and, as a consequence, the unit A travels laterally along an arc locus **41*a* in FIG. 12 which corresponds to the arc curve of the arc cam surface 86 on the cam surface 82**.

Consequently, due to the above-described travelling fashion of the unit A, the foremost ends of the finger pieces 31, 32 with the toe section 3 of the hose firstly move away from the needle **89*a* of the sewing machine 89, and next laterally along an arc locus 41*b* which corresponds to the curved locus 5*a* in FIG. 6. During the travelling contact of the cam follower 41 with the arc cam surface 86, the fixed sewing machine 89** completes toe closing on the hose.

Figure 15:
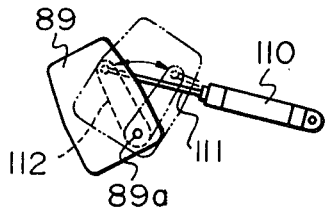
FIG. 15 is a plan view of a modified embodiment of the sewing machine in accordance with the present invention.

A modification of the sewing machine 89 advantageously usable for toe closing in the present invention is shown in FIG. 15, in which the sewing machine 89 is swingable about the axis of its needle **89*a* in synchronism with the arc movement of the toe section 3 of the hose so that the arched sew line 5*b* intersects always normally the center of the arc movement of the toe section 3**, thereby assuring further stable toe closing operation.

To this end, the sewing machine 89 is accompanied with proper means for swinging the sewing machine 89 about the axis of the needle **89*a*. The swinging means comprises, for example, a pneumatic pressure cylinder 110 having a piston 111. The outer end of the piston 111 is pivoted to one end of a lever 112 which is pivotal at another end to the axis of the needle 89*a* and comovably coupled to the sewing machine 89. Upon actuation of the cylinder 110, the lever 112 with the sewing machine swings about the axis of the needle 89*a*. The moving speed of the piston 111 is adjusted so as to synchronize with the speed of the finger pieces 31 and 32** in their lateral movement.

In accordance with the present invention, the sewing machine 89 is associated with complementary means for stably and successfully feeding the toe section into the space between the cloth clamper **89*b* and the needle plate 89*c*. In the case of the illustrated embodiment, the feeding means includes two air jet nozzles 101 and 102** arranged close to the above-described space.

Figure 13:
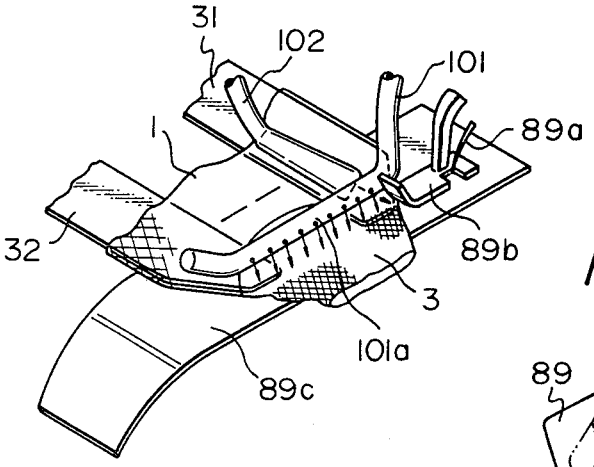
FIG. 13 is a perspective view of the sewing region on the sewing machine.

As shown in FIG. 13, one jet nozzle 102 is provided in its bottom surface with a number of aligned fine ejection apertures **101*a* so that air jets flow in the direction shown with arrows. These air jets let the free toe section 3, which extends beyond the foremost ends of the finger pieces 31 and 32, extend well beyond the top surface of the needle plate 89*c* so that the toe section 3** can be fed into the above-described space in a stable state.

Another jet nozzle 102 is provided with a flat distal mouth which is directed towards the front end of the cloth clamper **89*b*. An air jet is ejected by this jet nozzle 102 only when the leading and tail terminals of the toe section 3 pass by the front section of the cloth clamper 89*b* so that the terminals of the toe section 3 can be fed to the space between the cloth clamper 89*b* and the needle plate 89*c*** without fail whilst stretching the terminals by the blow of the air jet.

Figure 14:
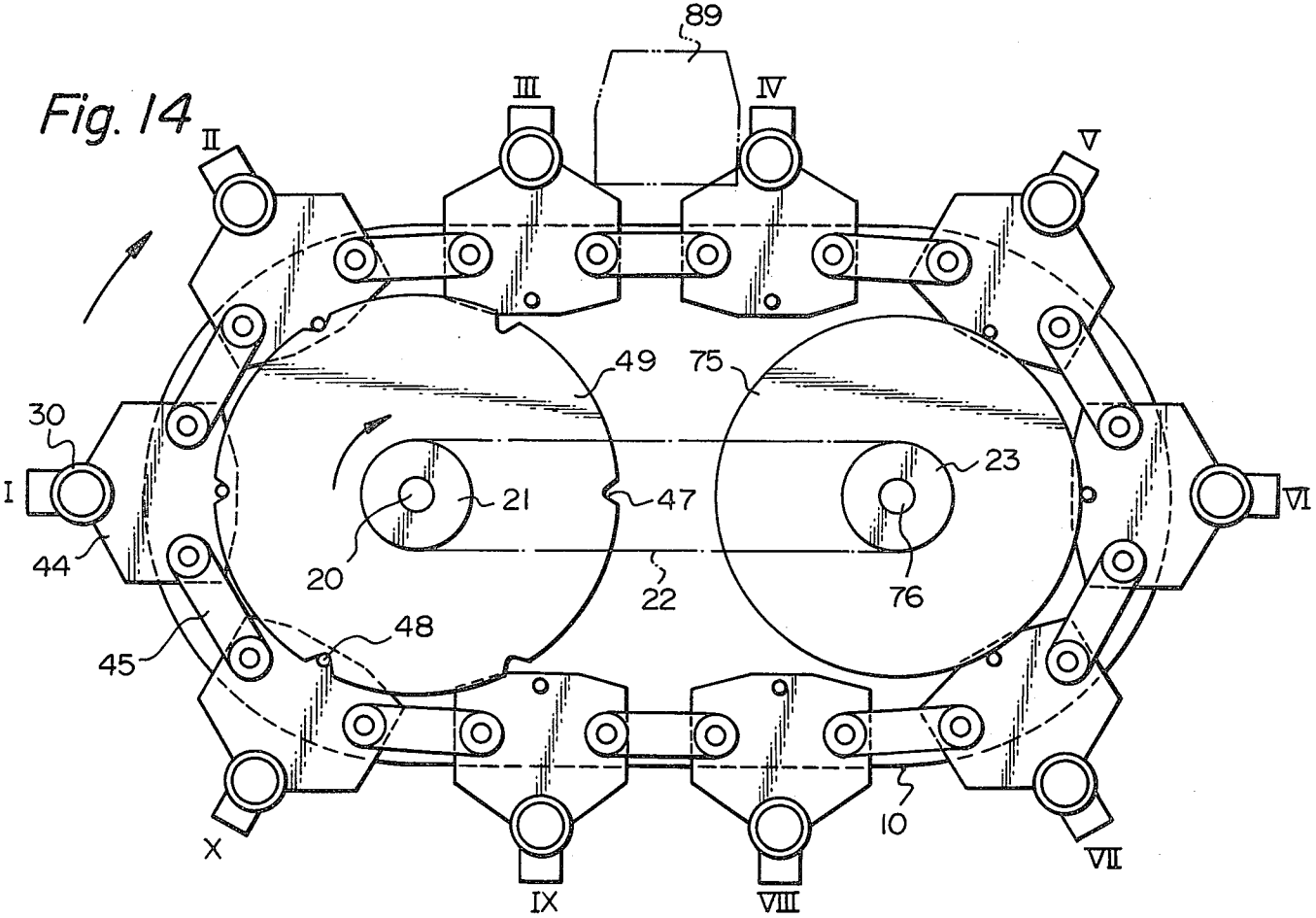
FIG. 14 is a top view of a toe closer to which the present invention is applied.

One example of the toe closing machine embodying the present invention is shown in FIG. 14, in which ten sets of brackets 44 arranged at equal intervals travel along an endless course set on an oblong horizontal pedestal 10. The brackets 44 are coupled in series by means of chain links 45 pivoted at both ends to adjacent brackets 44.

A drive shaft 20 and a driven shaft 76 are rotatably arranged on the pedestal 10. A sprocket 21 secured on the drive shaft 20 and a sprocket 23 secured on the driven shaft 76 are operationally connected by an endless chain 22. A drive drum 49 is secured to the drive shaft 20 whereas a guide drum 75 is secured to the driven shaft 76.

The drive drum 49 is provided its periphery with a plurality of recesses 47 formed at equal intervals and each bracket 44 is provided with a top projection 48 engageable with the recesses 47 in the drive drum 49. Obviously, the pitch between adjacent recesses 47 in the drive drum 49 is tantamount to that between the projections 48 on adjacent brackets 44.

In the state shown in FIG. 14, three sets of brackets 44 are in engagement with the drive drum 49 by means of the above-described projection-recess engagement.

Further, ten sets of operational stations I through X are set on the travelling course of the brackets 44 at equal intervals.

During the travel of the bracket 44 from station I to station II, an operator of the machine subjects the toe section 3 of a hose to pneumatic suction by the suction pipe 30 accompanying a bracket 44 whilst holding its welt section. After cancelling the pneumatic suction, the welt section is folded up to cover the outer periphery of the suction pipe 30 and the remnant is rolled up positively and automatically on the suction pipe in order to set or turn the hose inside out. In this case, the toe section 3 is left outside the suction pipe 30 so that both terminals of the uniting line 4 can be registered at the front corners **31*a* and 32*a* of the finger pieces 31 and 32 in the open state in FIG. 4**.

During the travel of the bracket 44 from station II to station III, the pair of finger pieces 31 and 32 are brought into the open state for movement from each other in order to stretch the toe section outwards as shown in FIG. 5 and the finger pieces 31 and 32 are driven for movement towards the sewing machine as shown in FIG. 6.

During the travel of the bracket 44 from station III to station IV, the cam follower 41 shifts laterally following the contours of the cam surfaces 85 and 86 and, being asisted by repulsion of the spring 81, the finger pieces 31 and 32 holding the toe section 3 move laterally along the arc locus **41*b* in FIG. 12 which corresponds to the contours of the cam surfaces 85 and 86**.

When the cam follower 41 is in contact with the cam surface 85, the leading terminal of the toe section 3 approaches the sewing machine 89 and is forced into the space between the cloth clamper **89*b* and the needle plate 89*c*. Just at this moment, air jet is ejected by the jet nozzle 102 in order to keep the leading terminal of the toe section 3 in a stretched state. This jet air assures stable and successful feeding of the leading terminal of the toe section into the space between the cloth clamper 89*b* and the needle plate 89*c***.

Next, the cam follower 41 comes in contact with the arc cam surface 86 of the cam plate 82 and ejection of the air jet by the jet nozzle 102 is stopped. During the period in which the cam follower 41 travels from the starting point 86*a* to the middle point 86*b* on the cam surface 86, the finger pieces 31 and 32 holding the toe section 3 move away from the needle 89*a* on the sewing machine 89 along an arc locus. During the shift of the cam follower 41 from the middle point 86*b* to the final point 86*c* on the cam surface 86, the finger pieces 31 and 32 holding the toe section moves laterally towards the needle 89*a* along an arc locus.

Namely, upon lateral travel of the cam follower 41 along the arc cam surface 86, the finger pieces 31 and 32 holding the toe section 3 also travel laterally along the arc locus 41*b* in FIG. 12. Thus, the toe section 3 is fed into the space between the cloth clamper 89*b* and the needle plate 89*c*, brought towards the needle 89*a* assuming an arc shape due to the operation of a feed wheel (not shown) of the sewing machine 89, and closed finally.

Just before the cam follower 41 arrives at the final point 86*c* on the cam surface 86, ejection of an air jet is restarted at the jet nozzle 102 in order to stretch the trailing terminal of the toe section 3 for stable and successful introduction into the space between the cloth clamper 89*b* and the needle plate 89*c*.

The other jet nozzle 101 is actuated during the period in which the cam follower 41 travels from the starting point 86*a* to the final point 86*c* on the arc cam surface 86. In other words, ejection of air jets by the jet nozzle 101 lasts from the start to the end of the toe closing operation so that the free toe section 3 will constantly follow the top face of the needle plate 89*c*.

It is clear from the foregoing description that cooperation of the cam follower 41 with the arm cam surface 86 on the cam plate 82 allows the toe section 3 to travel laterally along the curved locus 5*a* with respect to the straight sew line 5 of the sewing needle 89*a*. As a result, the sew line on the closed hose assumes the arc form of the line 5*b* which is the reverse of the curved locus 5*a* while concurrently forming the round fringe 6.

During the travel of the bracket 44 from station IV to station V, the finger pieces 31, 32 recede off the sewing machine 89 and are brought into the closed state during the recession.

As the bracket 44 travels from station V to station VI, the welt section 2 of the hose is positively and automatically rolled into the suction pipe 30.

During travel of the bracket 44 from station VI to station VII, pneumatic suction is revived in order to suck the toe section 3 into the suction pipe 30 while rolling back the hose rolled up on the outer side of the suction pipe 30.

The toe closed hose in the initial state is pneumatically passed to the next process as the bracket 44 travels from station VIII to station IX.

In accordance with the present invention, it is not required to use a particular type of sewing machine provided with upper and lower clamping devices for toe closing while carrying out a circular movement. Any conventional fized sewing machine is usable for practice of toe closing. In addition, since the hose is moved along an arc locus by engagement of the cam follower with the arc cam surface, an arc sew line is formed on the toe section of the hose and a resultant hose in a free state is provided with a closed toe section of a sufficiently small radius of curvature. Ejection of the air jets in the sewing region puts the toe section in an ideal form on the needle plate and assures stable and successful feeding of terminals of the toe section into the sewing region even at a high running speed of the apparatus.

I claim:

1. Improved method for closing the toe end of a hose comprising manually inserting a material hose inside out over a pair of fingers pieces with its toe section extending beyond the front ends of the said finger pieces, automatically moving said front ends of said finger pieces away from each other in order to stretch and open said material hose, automatically moving said front ends of said finger pieces with said toe section laterally towards the sewing region on a sewing machine whilst maintaining the stretched and open state of said material hose, automatically moving said front ends of said finger pieces with said toe section across said sewing region along a prescribed locus including an arc section, closing said toe section by said sewing machine during its travel along said prescribed locus, blowing both terminals of said toe section by a first air jet nozzle in a direction parallel to said hose only when either of said terminals passes by a cloth clamper of said sewing machine, and blowing said toe section by a second air jet nozzle during the closing process for stable and successful passage of said toe section across said sewing region.

2. Improved apparatus for closing the toe end of a hose comprising a holding unit for holding a hose material and including a pair of elongated finger pieces arranged in a side-by-side relationship, and front end moving means for moving the front ends of said finger pieces away from and towards each other at prescribed timings, a sewing machine including a needle, a cloth clamper and a needle plate arranged in its sewing region, drive means for driving said holding unit for horizontal movement in a direction substantially normal to the longitudinal direction of said finger pieces, a cam plate operationally coupled to said holding unit in order to urge the front ends of said finger pieces to travel across said sewing region on said sewing machine along a prescribed arc locus, a first air jet nozzle arranged in said sewing region and including ejection mouths facing said needle plate, and a second air jet nozzle arranged in said sewing region and including an ejection mouth facing said cloth clamper.

3. Improved apparatus as claimed in claim 2 in which said sewing machine is arranged at a fixed position.

4. Improved apparatus as claimed in claim 2 in which said sewing machine further includes means for swinging said sewing machine about the axis of said needle.

5. Improved apparatus as claimed in claim 2, 3 or 4 in which said first air jet nozzle is actuated for pneumatic ejection as said toe section of said hose material carried by said holding unit travels through said sewing region.

6. Improved apparatus as claimed in claim 2, 3, or 4 in which said second air jet nozzle is actuated for pneumatic ejection only when a terminal of said toe section of said hose material carried by said holding unit passes by said cloth clamper.

7. Improved apparatus as claimed in claims 2, 3, or 4 in which said holding unit further includes a suction pipe which is arranged between said pair of finger pieces and provided at its front end with a head piece idly engageable with said front ends of said finger pieces.

8. Improved apparatus as claimed in claim 7 in which said drive means includes a bracket movable in said normal direction, and idly inserted over said suction pipe.

9. Improved apparatus as claimed in claim 8 in which said front end moving means of said holding unit includes a middle slider idly inserted over said suction pipe at a position in front of said bracket and pivotably mounting the middle of said finger pieces at the lateral ends of said middle slider a rear slider idly inserted over said suction pipe at a position near the rear ends of said finger pieces, and provided with a slot extending in a direction normal to the longitudinal direction of said finger pieces, a rotary disc horizontally mounted atop said rear slider, and provided in its bottom with a pair of arc grooves which are symmetric with respect to the center of said rotary disc and extend over a prescribed center angle, and a pair of vertical pins secured atop said rear ends of said finger pieces and engaged with said arc grooves in said rotary disc via said slots in said rear slider.

10. Improved apparatus as claimed in claim 9 in which said holding unit further includes a cam follower mounted atop said rotary disc, and a compression spring interposed between said bracket and said rear slider, whereby said cam follower is constantly placed in resilient pressure contact with cam surfaces of said cam plate.

* * * * *